United States Patent [19]

Hocking

[11] 4,223,302

[45] Sep. 16, 1980

[54] CONDITIONS MONITORING DEVICE

[75] Inventor: Guy E. Hocking, Tularosa, N. Mex.

[73] Assignee: Marvel Engineering Company, Melrose Park, Ill.

[21] Appl. No.: 17,398

[22] Filed: Mar. 5, 1979

Related U.S. Application Data

[63] Continuation-in-part of Ser. No. 805,723, Jun. 13, 1977, abandoned.

[51] Int. Cl.[2] ..... G08B 25/00

[52] U.S. Cl. ..... 340/525; 340/517; 340/518; 340/520

[58] Field of Search ..... 340/525, 524, 517, 518, 340/519, 520, 502, 503, 505, 523

[56] References Cited

U.S. PATENT DOCUMENTS

| | | | |
|---|---|---|---|
| 3,541,550 | 11/1970 | Hamre | 340/518 |
| 3,543,266 | 11/1970 | Morris | 340/517 |
| 3,812,487 | 5/1974 | Burton | 340/518 |
| 3,872,473 | 3/1975 | Melgaard et al. | 340/517 |
| 3,882,492 | 5/1975 | McSorley et al. | 340/150 |
| 3,921,168 | 11/1975 | Dunbar | 340/518 |
| 3,987,439 | 10/1976 | Spaniola | 340/518 |
| 3,988,730 | 10/1976 | Valker | 340/517 |

*Primary Examiner*—John W. Caldwell, Sr.
*Assistant Examiner*—Donnie L. Crossland
*Attorney, Agent, or Firm*—Kinzer, Plyer, Dorn & McEachran

[57] ABSTRACT

A conditions monitor circuit for repetitively displaying the condition of a plurality of sensors which recognize different conditions includes a plurality of gates that are divided into groups which specify conditions for their respective sensors. The gates in each group are connected to a particular sensor and there is a clock for sequentially enabling each group of gates. The enabling clock pulse for each group of gates is also connected to a driver circuit to indicate which sensor is being interrogated. The gates in each group are connected to all of the conditions indicating driver circuits through diodes. There are display means connected to the driver circuits for indicating both the particular sensor being scanned and the condition of that sensor.

1 Claim, 2 Drawing Figures

B+
INHIBIT INPUT
54
56
50
52
58
62
66
72
INHIBIT OUTPUT
60
64
68
70

CONDITIONS MONITORING DEVICE

SUMMARY OF THE INVENTION

This application is a continuation-in-part of copending application Ser. No. 805,723, filed June 13, 1977 now abandoned.

The present invention relates to a conditions monitor circuit and particularly to a monitor circuit which displays the particular sensor being scanned and the condition of that sensor with a minimum number of indicating means, for example light bulbs or the like.

A primary purpose of the invention is a simply-constructed reliably operable monitor circuit providing usable information as to the condition of a plurality of sensors, with a minimum number of indicating devices.

Another purpose is a conditions monitor circuit which provides one indicating device for each sensor and a small group of devices for displaying the condition of any one of the sensors.

Other purposes will appear in the ensuing specification, drawings and claim.

BRIEF DESCRIPTION OF THE DRAWINGS

The invention is illustrated diagrammatically in the following drawings wherein.

DESCRIPTION OF THE PREFERRED EMBODIMENT

Figure 1:
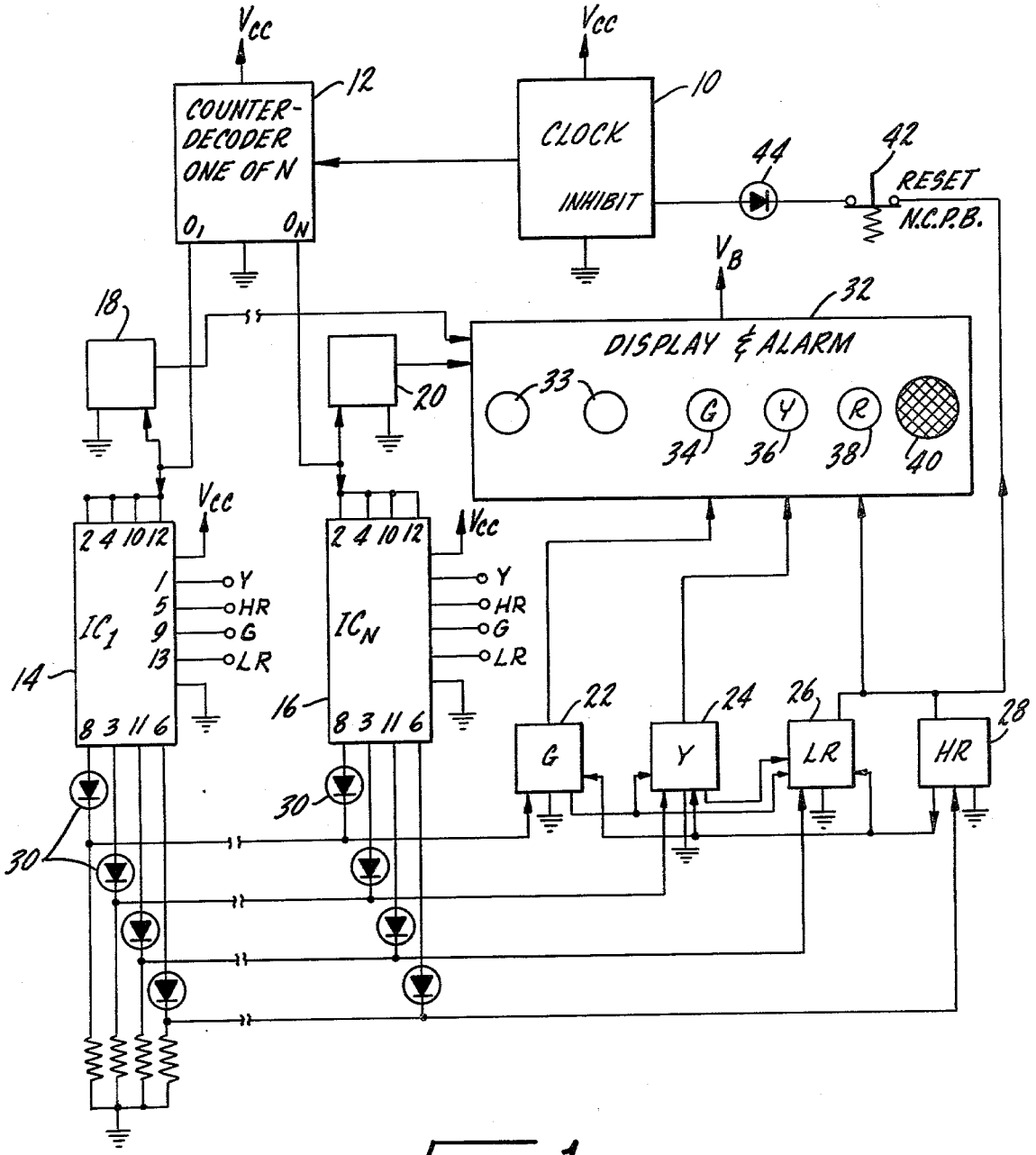
FIG. 1 is a schematic illustration of the monitor circuit disclosed herein.

The present circuit has utility in monitoring a number of individual sensors which may, for example, be associated with a vehicle, aircraft, boat or the like. For example, battery condition, the level of lubricating oil, hydraulic fluid, temperatures in the engine, are just a few of the various conditions which may be monitored by the present circuit. The circuit provides an indicator for each sensor and then a series of indicators to show the condition of the particular sensor being scanned at any one instance. The sensors are sequentially and repetitively scanned and, at any one instant of time, one light indicative of a particular sensor will be illuminated, as will one of the condition lights. The indicators are arranged in customary colors of red, yellow and green, with the green indicating an OK condition, the yellow indicating a caution condition, and the red indicating a dangerous condition. If all sensors are indicating that their particular area of concern is in good operating order, then the green indicator will remain lit. The devices which indicate which sensor is being interrogated will be regularly and sequentially activated as different sensors are interrogated or scanned. If, however, a caution is indicated at one location, then there may be a yellow indicator periodically flashing between periods of green as the various sensors are scanned. A red indication will cause the initiation of an audible alarm and will also stop the clock from repetitively scanning the individual sensors until the clock disable circuit is bypassed or until the faulty condition is corrected. Thus, a red indicator, which may indicate either a high condition or a low condition or any other unacceptable or dangerous condition, will immediately alert the operator that attention is needed in that particular area of concern.

In the drawings, a clock generator is indicated at 10 and may have a clock period of approximately one second, although this is merely an example of one satisfactory period. The clock 10 is connected through a counter-decoder 12 to a plurality of integrated circuits, for example 7408s manufactured by Texas Instruments, indicated at 14 and 16. There may be any number of such integrated circuits and the two designated herein as $IC_1$ and $IC_N$ are representative of the first and last in a series. The output of counter-decoder 12 is also connected to trigger circuits 18 and 20. There is a trigger circuit for each IC. The number of integrated circuits and their corresponding trigger circuits will depend upon the number of stations to be monitored by the conditions monitor circuit.

Each of the integrated circuits contain four two-input AND gates. The clock signals for the four ANd gates in each IC are connected to pins 2, 4, 10 and 12. Pins 1, 5, 9 and 13 of each integrated circuit may be connected to a particular sensor, or left floating in the case of "go-no go" sensors. For example, pin 1 may be connected to the caution indicator for the sensor; pin 5 to the high indicator of the sensors; in 9 to the OK indicator of the sensor; and pin 13 to the low indicator of the sensor. If the sensor connected to a particular IC was measuring battery condition, a particular voltage level at pin 9 would indicate that the battery was approximately charged. A particular voltage level at pin 1 would indicate that the battery was slightly low, a particular voltage level at pin 13 would indicate that the battery was too low to restart the engine, and a particular voltage at pin 5 would indicate an overcharge condition.

The output terminals for the ICs are pins 8, 11, 6 and 3. Pin 3 provides the output for the AND gate having an input at pin 1; pin 6 provides the output for the AND gate having an input at pin 5; pin 11 provides the output for the AND gate having an input at pin 13; and pin 8 provides an output for the AND gates having an input at pin 9. All of the ICs will be connected in a similar pattern, with each group of four AND gates being connected to a particular sensor.

Counter-decoder 12 will enable each group of four AND gates at one second intervals in the described example and will simultaneously activate the associated driver circuit to indicate which sensor is being interrogated.

The outputs of the integrated circuits are connected to output driver circuits 22, 24, 26 and 28. All of the pin 8 outputs will be connected to driver circuit 22; all of the pin 3 outputs will be connected to driver circuit 24; all of the pin 11 outputs will be connected to driver circuit 26; and all of the pin 6 outputs will be connected to driver circuit 28. All of the connections will be made through diodes indicated at 30 to prevent interaction of the groups of gates.

The display and alarm means is indicated at 32 and will include indicating devices 33 which will indicate the particular sensor being currently interrogated. Again, there will be an indeterminate number of such devices, depending upon the number of ICs and the number of driver circuits of the type indicated at 18 and 20. The display and alarm means 32 will also include green, yellow and red indicating lamps which are designated 34, 36 and 38, respectively. There may be an audio alarm whose presence is indicated by a speaker 40. Driver circuit 22 is connected to lamp 34; trigger circuit 24 to lamp 36; and driver circuits 26 and 28 to lamp 38. Driver circuits 26 and 28 are also connected through a reset switch 42 and a diode 44 to the inhibit terminal of clock 10.

There are inhibit connections between driver circuits 22-28. The output of driver circuit 22 will provide inhibit signals for driver circuits 24 and 26. Driver circuit 24 will provide an inhibit signal for trigger circuit 26 and trigger circuit 28 will provide an inhibit signal for trigger circuits 26, 24 and 22.

Figure 2:
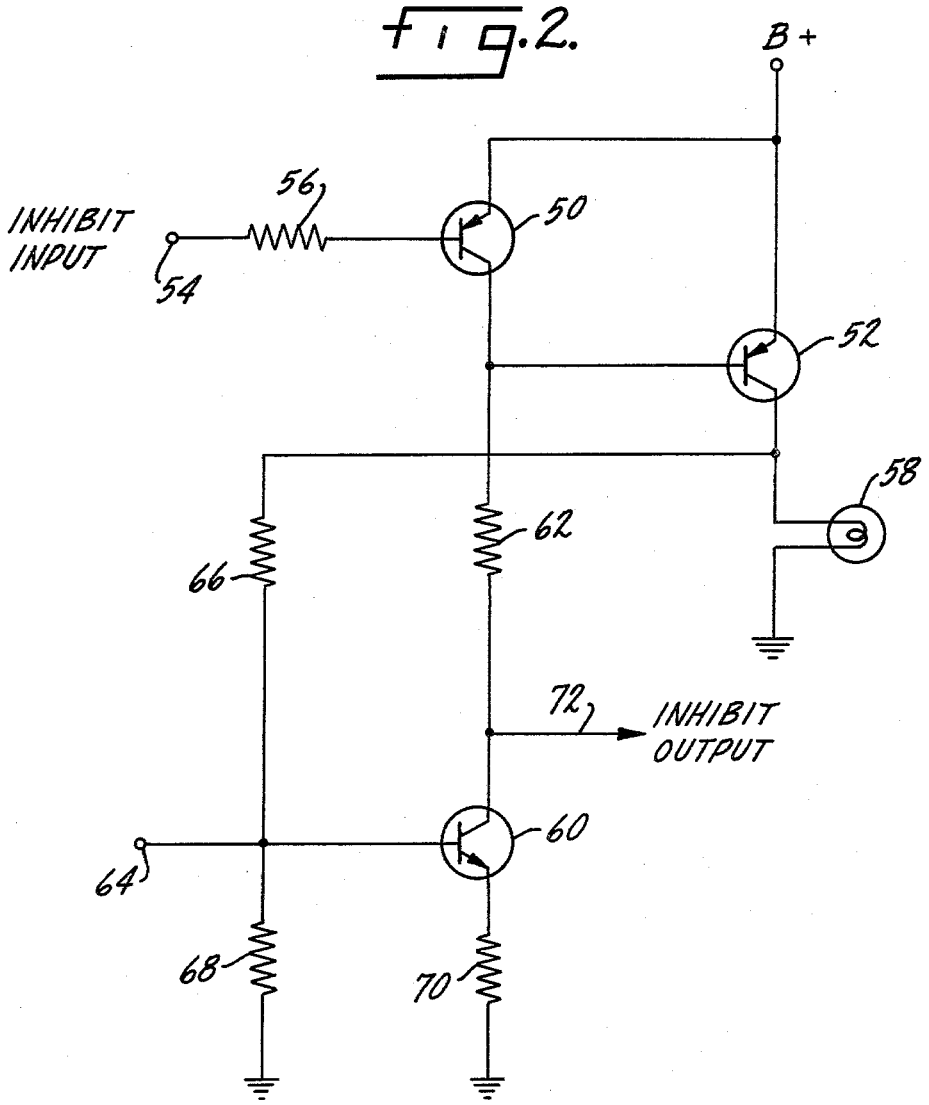
FIG. 2 is an electrical schematic of one of the trigger circuits used in FIG. 1.

FIG. 2 is typical of trigger circuits 22, 24, 26 and 28 and is included herein as an illustration of any one of such circuits. Transistors 50 and 52 have their respective emitters connected to a source of positive voltage. The inhibit input for the circuit is indicated at 54 and is connected through a resistor 56 to the base of transistor 50. The collector of transistor 50 is connected to the base of transistor 52 and the collector of transistor 52 is connected to an indicator lamp 58 which may represent any one of lamps 34, 36 or 38.

A transistor 60 has its collector connected through a resistor 62 to the collector of transistor 50 and the base of transistor 52. The collector of transistor 50 is also connected to the base of transistor 52. Transistor 60 has a base input indicated at 64 which will be the input from the ICs described above. A resistor 66 connects input 64 to the collector of transistor 52 and resistors 68 and 70 are connected respectively between the base of transistor 60 and ground and the emitter of transistor 60 and ground.

Transistors 60 and 52 in combination provide a Schmitt trigger circuit. Thus, upon an input signal of the type described at input 64 transistors 60 and 52 cooperate in a manner to provide an inhibit output on terminal 72, which is connected to the collector of transistor 60. Output terminal 72 provides the inhibit signal for the other associated trigger circuits. An input signal at terminal 64 will also cause the operation of transistors 60 and 52 to provide an output from transistor 52 to operate lamp 58. If an inhibit signal has been applied at terminal 54, transistor 50 will operate in a manner to prevent the operation of transistor 52 and thus prevent signal lamp 58 from being activated.

In operation, as indicated above, counter-decoder 12 will interrogate each of the sensors at one second intervals. When clock pulses are received at pins 2, 4, 10 and 12 of one of the integrated circuits, the sensor associated with pins 1, 5, 9 and 13 will have a voltage level indicative of a particular condition. Assuming the voltage level from the sensor indicates that the sensor is giving at least an OK indication, pin 9 will have a particular voltage level so that the AND gate associated with that pin will provide an output voltage at pin 8. This will provide an input voltage to Schmitt trigger circuit 22 which will cause green lamp 34 to be activated, indicating that the particular sensor being scanned is showing an OK indication. Simultaneously, the clock pulse received at pins 2, 4, 10 and 12 will be directed to Schmitt trigger circuit 18 which will cause the indicator device associated with that sensor to be activated for the period of the clock pulse.

When trigger circuit 22 is activated in the above-described manner, inhibit signals will be applied to circuits 24 and 26. This is done because the voltage level at a particular sensor indicative of an OK condition would also be of sufficient amplitude to cause activation of the yellow and red lamps. However, the latter two would be false indications and therefore the trigger circuits are inhibited when a green or OK condition is recognized. Trigger circuit 28 indicating a high red condition would normally be activated by a voltage level higher than that for the green level and, thus, whenever this trigger circuit is activated, all other trigger circuits are inhibited.

It should be noted that operation of either trigger circuits 26 or 28 will place an inhibit signal on the clock and will simultaneously operate the audible alarm 40. Reset button 42, when open, will again permit the clock to resume its normal sequence. Absent operation of the reset button 42, the clock will hold on the particular sensor until the faulty condition is corrected.

The result of the various inhibit conditions applied to the output trigger circuits described above is to insure that only one indicating device is activated at any one time even though the sensor shows a voltage level high enough to cause several trigger circuits and their associated indicators to be activated at any one time.

Although we have described a sensor as having various levels, a sensor could be a single wire and switch to ground which, if connected to pin 6, would be a "go-no go" (green-red) situation, as in the case of a cargo door being left open or a latch or securing device on any type of vehicle or aircraft.

The sensors will be scanned in sequence by the signals from counter-decoder 12 and thus the integrated circuits will be activated in sequence. If all sensors are indicating OK, green lamp 34 will stay lit and the various identifying lamps 33 will be sequentially lit. If, however, a caution condition is present at a particular sensor, for example that associated with a particular integrated circuit, then a voltage level at pin 1 of that integrated circuit will provide a voltage at Schmitt trigger circuit 24 causing yellow lamp 36 to be lit. Assuming this is the only caution lamp being lit, the yellow lamp will periodically flash as its respective sensor is scanned, giving an operator an indication that there is a caution condition at some location. This location would be defined by the sensor indicator.

If one of the sensors indicates a high or low condition, then red lamp 38, associated with Schmitt trigger circuits 26 and 28 will be lit. This lamp will be lit regardless of whether there is a high or low condition, because either one can be dangerous.

The various control voltages for the integrated circuits will be applied in the conventional manner at the arrows indicated throughout the circuit and this material has not been described in detail, as it is clear to one skilled in the art. In like manner, details of the trigger circuits, clock generator and counter-decoder which may be conventional have not been disclosed.

Whereas the preferred form of the invention has been shown and described herein, it should be realized that there may be many modifications, substitutions and alterations thereto.

The embodiments of the invention in which an exclusive property or privilege is claimed are defined as follows:

1. A conditions monitor circuit for repetitively displaying the condition of a plurality of sensors each of which detect at least three different conditions including a plurality of gates divided into groups, there being at least three gates in each group, each gate being used in sensing a different condition, with all the gates of each group being connected to a particular sensor, an identifying display means for each sensor, common condition display means including at least three display devices, one for a danger condition, one for a caution condition and one for a satisfactory condition, clock means connected to each group of gates and said identifying display means for sequentially enabling each group of gates and the corresponding identifying display means, at least three trigger circuits, each trigger circuit being connected to a display device and connected to the corresponding gate in each group of gates, and interconnections between said trigger circuits whereby at least one of said trigger circuits, when activated, disables the others.

* * * * *